US010045602B2

(12) United States Patent
Pires et al.

(10) Patent No.: US 10,045,602 B2
(45) Date of Patent: Aug. 14, 2018

(54) COSMETIC APPLICATOR

(71) Applicant: Zen Design Solutions Limited, Kowloon (HK)

(72) Inventors: Leo Clifford Pires, Basking Ridge, NJ (US); Roger Hwang, Maple (CA); Smita Srivastava, New Delhi (IN); Rahul Bose, New Delhi (IN)

(73) Assignee: ZEN DESIGN SOLUTIONS LIMITED, Kowloon, Hong Kong (CN)

( * ) Notice: Subject to any disclaimer, the term of this patent is extended or adjusted under 35 U.S.C. 154(b) by 275 days.

(21) Appl. No.: 14/617,636

(22) Filed: Feb. 9, 2015

(65) Prior Publication Data

US 2015/0230588 A1 Aug. 20, 2015

(30) Foreign Application Priority Data

Feb. 20, 2014 (IN) ..... 493/DEL/2014

(51) Int. Cl.
*A45D 40/26* (2006.01)
*A46B 9/02* (2006.01)

(52) U.S. Cl.
CPC ..... *A45D 40/262* (2013.01); *A46B 9/021* (2013.01); *A46B 2200/1053* (2013.01); *Y10T 29/49826* (2015.01)

(58) Field of Classification Search
CPC .... A45D 40/26; A45D 40/265; A45D 40/262; A46B 9/021; A46B 9/02; A46B 9/025; A46B 9/026; A46B 9/028; A46B 2200/1046; A46B 2200/1053; A46B 3/005; A46B 11/06; A46B 1/00; A46B 7/04; A46B 7/044; A46B 7/046; A46B 7/048
USPC .. 15/144.4, 172, 176.1, 176.2, 176.6, 176.3, 15/186–188; 401/116, 110
See application file for complete search history.

(56) References Cited

U.S. PATENT DOCUMENTS 2,029,835 A * 2/1936 Reichle ..... A45D 34/045 132/73
4,545,393 A 10/1985 Gueret et al.
6,260,558 B1 * 7/2001 Neuner ..... A46B 9/021 132/218
7,226,555 B2 6/2007 Weihrauch
(Continued)

*Primary Examiner* — Cris L Rodriguez
*Assistant Examiner* — Brianne Kalach
(74) *Attorney, Agent, or Firm* — Patterson + Sheridan, LLP

(57) ABSTRACT

The present disclosure relates to a cosmetic applicator for applying a cosmetic, makeup, or a care product on skin, lips or on keratinous fibers. The cosmetic applicator comprises an application member assembly at a distal end of a rod and a handle at a proximal end of a rod. The application member assembly comprises an elongated casing with a hollow cavity, a multiplicity of application elements projecting from an outer surface of the casing, a non-resilient member disposed within the hollow cavity and extending along a length of the casing; wherein the non-resilient member comprises at least two progressively tightening and locking features in a locking region at its proximal end portion. The locking region is defined over a sufficient length of the non-resilient member which permits to attain different locking positions for the casing at the proximal end portion and thus varied lengths of the elongated casings can be used along with the same non-resilient member.

20 Claims, 8 Drawing Sheets

(56) References Cited

U.S. PATENT DOCUMENTS

| | | | | |
|---|---|---|---|---|
| 7,325,550 | B2 * | 2/2008 | Eckers | A46B 9/021 132/218 |
| 8,151,807 | B2 * | 4/2012 | Holloway | A45D 40/265 132/218 |
| 8,689,808 | B2 * | 4/2014 | Gueret | A45D 40/267 132/218 |
| 9,066,573 | B2 * | 6/2015 | Pires | A45D 40/26 |
| 2005/0249539 | A1 * | 11/2005 | Habatjou | A45D 40/265 401/127 |
| 2006/0042647 | A1 | 3/2006 | Vogel | |
| 2007/0033760 | A1 * | 2/2007 | Dumler | A45D 40/262 15/187 |
| 2007/0062551 | A1 * | 3/2007 | De Brouwer | A45D 34/045 132/218 |
| 2007/0062552 | A1 * | 3/2007 | De Brouwer | A45D 34/045 132/218 |
| 2009/0194127 | A1 * | 8/2009 | Pires | A45D 40/265 132/218 |
| 2010/0269842 | A1 * | 10/2010 | Gueret | A45D 40/267 132/200 |

* cited by examiner

COSMETIC APPLICATOR

CROSS-REFERENCE TO RELATED APPLICATION

This application claims benefit of Indian Provisional Application Ser. No. 493/DEL/2014, filed Feb. 20, 2014, which is incorporated by reference in its entirety.

BACKGROUND

Field of the Invention

The present disclosure generally relates to a cosmetic applicator for applying a cosmetic, makeup, or a care product on skin or on keratinous fibers in the area of mascara application, lash care, mascara removal, lip application, hair coloring and hair repair etc.

Description of the Related Art

Numerous cosmetic applicators are known that are used for applying a product to keratinous material. Conventionally, the cosmetic applicator comprises a molded application member at a distal end of a rod and a handle at a proximal end of the rod.

U.S. Pat. No. 7,325,550 discloses a cosmetic applicator comprising a rigid body overmolded with an application surface made of more resilient material and equipped with application elements. The body comprises relief elements which allow the more resilient part to be retained on the rigid body.

U.S. Pat. No. 7,226,555 likewise discloses a cosmetic applicator, comprising a hollow rigid portion inside which a more resilient material is injected. The hollow portion further comprises radial orifices through which the soft material is able to emerge in order to form application elements.

In the foregoing two types of cosmetic applicators, the resulting application elements are resilient, since they are made of soft material. However, because the application elements are held at their base on a rigid part, they are greatly stressed when they pass, for example, through a wiper, or when they are applied to the eyelashes. If the material used is very soft, the application elements may be deformed as they pass through the wiper. Furthermore, given that the application elements recline when they pass through the wiper, they are wiped to a great extent, so that the product load remaining on the wiped application elements is affected.

U.S. Pat. No. 4,545,393 describes a mascara applicator comprising a tubular sleeve and a central rigid member which passes through the sleeve and is able to slide within it so as to vary the length of the application portion of the brush. The rigid member protrudes beyond the sleeve at an application end in such a way as to receive an elastomer sleeve tube serving for application of the product. The sleeve tube is retained at the distal end of the rigid member by a portion of the rigid member shaped as a rivet head. In another embodiment, a bellows which serves for application of the product is snap-fastened to the end of the sleeve. When the rigid member is slid in the sleeve, the sleeve tube or bellows undergoes deformation so as to vary the application length.

U.S. Pat. Application No. US 2006/0042647 describes a sleeve tube which carries bristles and is attached to a central core which in turn is fixed to the end of a rod.

U.S. Pat. No. 8,151,807, discloses a cosmetic brush assembly with an applicator rod, a brush sleeve with a tubular core member and a plurality of bristles, a rod hole in the distal end of the applicator rod, and a rivet for being received into the rod hole to retain the brush sleeve. A peripheral retaining wall can retain and protect a proximal end of the brush sleeve. The brush sleeve can have radially projecting, diamond-shaped bristles and can be slidably received over a body portion of the rivet or over a support stem forming a distal portion of the applicator rod. Since, the proximal end of the brush sleeve is retained by the peripheral retaining wall at the distal end of the rod hole, there are chances that the sleeve may slip out of the peripheral wall. Further, the sleeve is fixed to the rod by hot or cold crimping which gives an unaesthetic appearance.

There still exists a need in the art for a cosmetic applicator which provides gentle application and which is simple to manufacture.

There is also a need in the art to provide a cosmetic applicator which provides enhanced functional versatility that is thickening, lengthening and separation as well as delivery of mascara to eyelashes.

SUMMARY

The present disclosure generally relates to a cosmetic applicator for applying a cosmetic, makeup, or a care product on skin or on keratinous fibers in the area of mascara application, lash care, mascara removal, lip application, hair coloring and hair repair etc. More particularly, the present disclosure relates to a cosmetic applicator for applying a cosmetic, makeup, or a care product on keratinous fibers in the area of mascara application.

According to one embodiment of the disclosure, there is provided a cosmetic applicator comprising an application member assembly at a distal end of a rod and a handle at a proximal end of the rod. The application member assembly comprises a resilient elongated casing with a hollow cavity, a multiplicity of application elements projecting from an outer surface of the casing, a non-resilient member disposed within the hollow cavity and extending along a length of the casing.

According to another embodiment of the disclosure, the application member assembly further comprises a resilient elongated tubular casing having an open proximal end and an open distal end; and a multiplicity of application elements projecting outwardly from the outer surface over a major portion of the length of the casing. The proximal end portion of the casing is formed as a shank for attachment to the rod and is free from the application elements. A radially extending flange is provided between the shank and the application elements-bearing portion of the casing. The flange rests at the distal end of the rod.

According to another embodiment of the disclosure, the elongated casing is locked at its distal end and at its proximal end with respect to the non-resilient member disposed within the hollow cavity of the casing.

According to another embodiment of the disclosure, the non-resilient member comprises a head at its distal end, a main body portion and a proximal end portion. The non-resilient member further comprises a locking region at the proximal end portion. The locking region at the proximal end portion of the non-resilient member includes at least two progressively tightening and locking features.

According to another embodiment of the disclosure, the non-resilient member is inserted into the casing such that the head at the distal end of the non-resilient member is retained outside the casing at the distal end of the casing, locking the casing at the distal end with respect to the non-resilient member. The main body portion lies inside the hollow cavity of the casing and a portion of the locking region comprising at least two progressively tightening and locking features extends out from the proximal end of the casing.

According to an alternate embodiment of the disclosure, the non-resilient member is of a length longer than the length of the casing.

According to yet another embodiment of the disclosure, a portion of the locking region comprising at least two progressively tightening and locking features at the proximal end portion of the non-resilient member, lies inside the casing.

According to yet another embodiment of the disclosure, the portion of the locking region which lies inside the casing, is smaller than the portion of the locking region which extends out from the proximal end of the casing.

According to yet another embodiment of the disclosure, the at least two progressively tightening and locking features of the locking region at the proximal end portion of the non-resilient member includes at least two spiral threads, ribs, ratchets and the like.

According to yet another embodiment of the disclosure, the at least two progressively tightening and locking features at the proximal end portion of the non-resilient member preferably includes at least two unidirectional ratchets.

According to another embodiment of the disclosure, the application member assembly further comprises a locking member including locking features which are corresponding to and capable of being engaged to the at least two progressively tightening and locking features of the locking region at the proximal end portion of the non-resilient member, for retaining and optimally locking the casing at its proximal end with respect to the non-resilient member.

According to another embodiment of the disclosure, the locking member includes locking features including spiral threads, pawls, hooks and the like.

According to another embodiment of the disclosure, the application member assembly comprises a locking member including a tubular member including locking features in form of spiral threads on its inner surface wherein the spiral threads are complementary to the at least two progressively tightening and locking features in form of spiral threads at the proximal end portion of the non-resilient member. The tubular member is retained on to the proximal end portion of the non-resilient member by mating of the spiral threads on its inner surface with the corresponding spiral threads of the locking region at the proximal end portion of the non-resilient member for locking the casing at its proximal end with respect to the non-resilient member.

According to another embodiment of the disclosure, the application member assembly comprises a locking member including a ring member having a flat circular surface wherein the flat circular surface includes locking features for example at least one pawl complementary to the at least two progressively tightening and locking features in form of ratchets, preferably unidirectional ratchets, at the proximal end portion of the non-resilient member. The ring member is retained on to the proximal end portion of the non-resilient member by mating of the at least one pawl with the corresponding ratchets at the locking region of the proximal end portion of the non-resilient member, for locking the casing at its proximal end with respect to the non-resilient member.

According to another embodiment of the disclosure, the head at the distal end of the non-resilient member and the at least two progressively tightening and locking features at the proximal end portion of the non-resilient member engaged with the locking member, optimally lock the casing, at its distal end and proximal end, with respect to the non-resilient member. The length of the casing can be varied depending upon the length of the locking region at the proximal end portion of the non-resilient member.

According to another embodiment of the disclosure, a proximal end portion of the application member assembly is engaged into an elongated hole of the rod wherein the proximal end portion of the application member assembly is formed by the proximal end portion of the casing and the proximal end portion of the non-resilient member engaged with locking member.

According to another embodiment of the disclosure, the proximal end portion of the casing and the proximal end portion of the non-resilient member engaged with locking member are received into an elongated hole of the rod. The proximal end portion of the casing is fixed to the rod and the non-resilient member. In other words, the proximal end portion of the casing is fixed to the rod and to the non-resilient member so as to be sandwiched between the rod and the non-resilient member.

According to another embodiment of the disclosure, the proximal end portion of the casing is engaged inside the hole of the rod by suitable attachment means. The suitable attachment means includes a pin, a snap, a j-lock, a threaded engagement, an interference engagement or the like.

According to another embodiment of the disclosure, the proximal end portion of the casing includes an annular bead which is engaged with a corresponding recess inside the hole of the rod.

According to another embodiment of the disclosure, the proximal end portion of the casing is engaged in a friction fit with the hole of the rod.

According to yet another embodiment of the disclosure, the application elements may be in the form of bristles, teeth, sponge or flocking of fibers. The application elements are arranged in a plurality of rows extending lengthwise of the casing. The application elements in the plurality of rows may be arranged alternately to achieve a variety of configurations for such purposes as enhancing lash-thickening, lash-lengthening and/or lash-separation effects incident to mascara application. The application elements may be covered by a flock coating.

According to yet another embodiment of the disclosure, the casing and the application elements may be molded integrally from a material so that the application elements and the casing are soft and resilient in nature. The soft and resilient, casing and the application elements provide a very gentle application and avoid the risk of being impaired when they are stressed mechanically. They may be made, for example, of a material from the following list: elastomer, for example thermoplastic elastomer, LDPE, PVC, PU, thermoplastic polyester elastomer, EPDM, PDM, EVA, SIS, SEBS, SBS, latex, silicone, nitrile, butyl, polyurethane, polyether-block-amide, and polyester. They may be made of a single material or, by bi-injection-molding of two different materials, for example of two different colors.

As used herein, the term "non-resilient member" refers to an elongated element which is rigid and non-flexible so that it retains its shape. The non-resilient member is made up of a metal or a hard material which is capable of providing inflexible physical properties when used for its intended purpose. Apart from metal, the non-resilient member may be made from thermoplastic material selected from the following list: HDPE, LDPE, linear PE, PP, PT, POM, PA, PET and PBT.

According to another embodiment of the disclosure, the non-resilient member is made up of a material harder than the material of the casing. This results in an application member assembly which is sufficiently stiff to allow effective application on the area to be treated, due to the presence of the non-resilient core, while ensuring gentle application, due to the casing of more resilient material which comes into contact with the area to be treated.

According to another embodiment of the disclosure, the casing may have a cross-section selected from the following list: circular, polygonal, for example triangular, square, pentagonal or hexagonal, and oblong, for example lenticular-oval. The casing may have a cylindrical general form. The surface of the casing defining the cavity may be smooth.

According to another embodiment of the disclosure, the non-resilient member may be straight or may be curved over at least a part of its length.

According to another embodiment of the disclosure, the non-resilient member may be present along a longitudinal axis of the rod.

According to alternate embodiment of the disclosure, the longitudinal axis of the rod may form a non-zero angle with the longitudinal axis of at least a part of the non-resilient member.

According to another embodiment of the disclosure, the non-resilient member may define a center of symmetry for at least one cross section of the casing. In an alternate embodiment, the non-resilient member may be off-centered within a cross section of the casing. The cross section of the non-resilient member may have a general form selected from the following list: circular, polygonal, for example triangular, square, pentagonal or hexagonal, oblong, for example lenticular-oval, cruciform, V-shaped, or C-shaped. The non-resilient member may have a solid or hollow cross section.

According to another embodiment of the disclosure, the non-resilient member having a body portion for being received through the elongated hollow casing can be used to achieve varied cross-sectional and longitudinal profiles of the hollow casing. By way of example, the body portion can in certain cases have a non-circular cross section, such as a rounded triangular cross section, a rounded rectangle cross section, or a rounded square cross section, to cause the hollow casing to tend to pursue that same non-circular cross section. Additionally or alternatively, the body portion of the non-resilient member can have an arcuate/curved longitudinal profile to cause the hollow casing to pursue that same arcuate longitudinal profile. The tubular casing adapts to the curved profile of the non-resilient elongated member such that at least some of the application elements on a portion of the tubular casing converge towards each other and some of the application elements on another portion of the tubular casing diverge away from each other.

According to another embodiment of the disclosure, the handle at the proximal end of the rod is engaged to a neck of a container containing a cosmetic product.

According to another embodiment of the disclosure, there is provided an application device for accommodating and applying a cosmetic product, the application device comprising the cosmetic applicator described herein and a container containing the cosmetic product to be applied. The container may include a wiper attached into a neck of the container for wiping the cosmetic applicator.

According to another embodiment of the disclosure, there is provided a method of manufacturing the cosmetic applicator described herein, the method comprising assembling the application member assembly and then fixing (snap fitting) the application member assembly to a distal end of the rod having a handle at its proximal end.

According to another embodiment of the disclosure, there is provided a method of assembling an application member assembly comprising a casing including application elements on its outer surface, a non-resilient member and a locking member. The non-resilient member includes a head at its distal end, a main body portion and a proximal end portion, wherein the proximal end portion further comprises a locking region including at least two progressively tightening and locking features. The locking member includes locking features which are corresponding to and capable of being engaged to the at least two progressively tightening and locking features of the locking region of the non-resilient member. The method includes integrally molding the casing, wherein the casing has a hollow cavity, an open proximal end and an open distal end. The method further includes inserting the non-resilient member into the casing and fixing the casing at its distal end and proximal end with respect to the non-resilient member. The non-resilient member is inserted into the casing such that the head at the distal end of the non-resilient member is retained at the distal end of the casing, locking the casing at the distal end with respect to the non-resilient member. The locking features of the locking member are engaged to the at least two progressively tightening and locking features of the locking region of the non-resilient member to lock the casing, at its proximal end, with respect to the non-resilient member. The length of the casing can be varied depending upon the length of the locking region at the proximal end portion of the non-resilient member.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
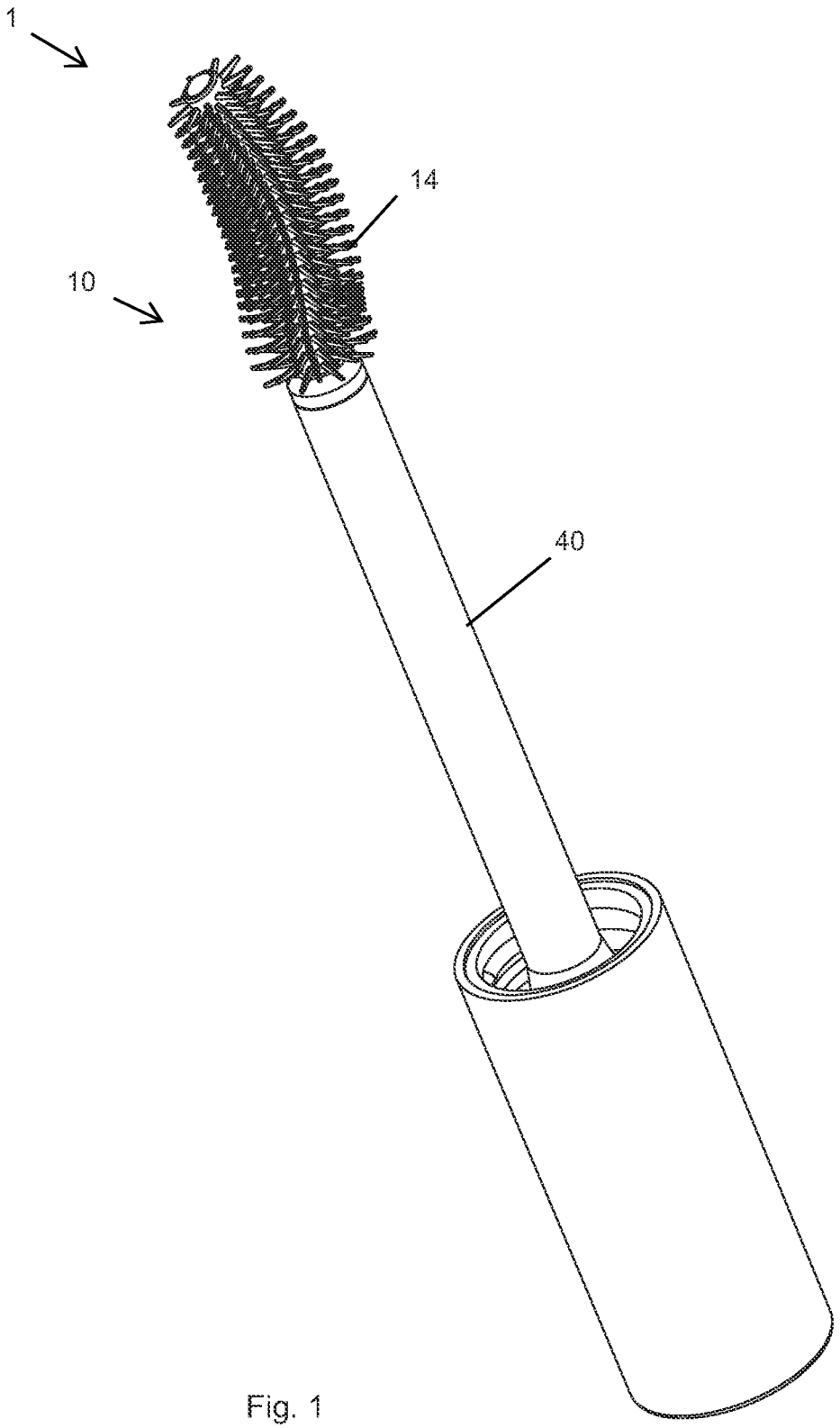
FIG. 1 illustrates a perspective view of a cosmetic applicator according to one embodiment of the disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 2:
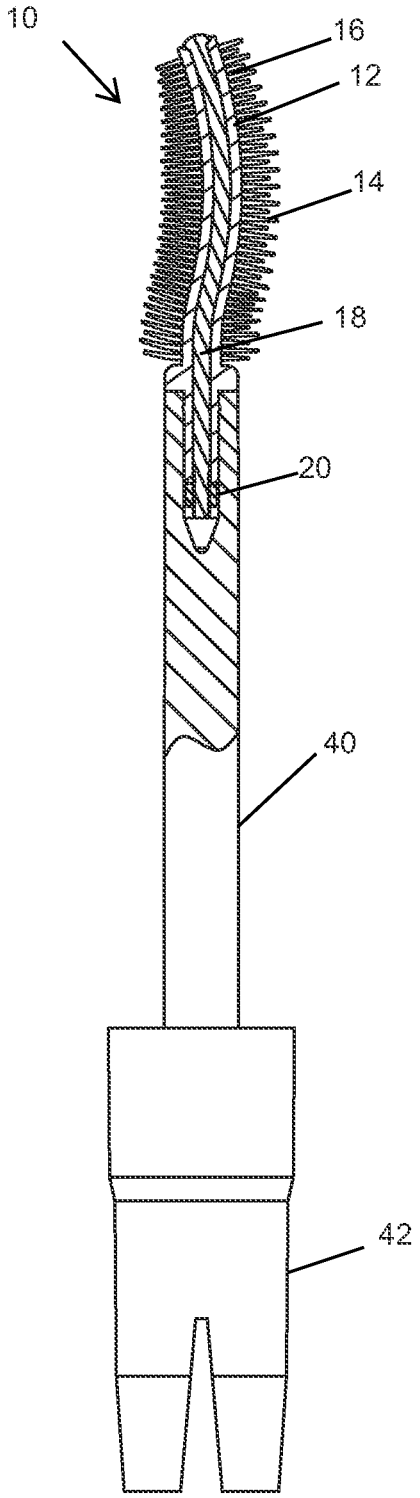
FIG. 2 illustrates a partial cross-sectional view of the cosmetic applicator of FIG. 1 with the handle removed.

FIG. 1 and FIG. 2 illustrate a cosmetic applicator 1 according to one embodiment of the disclosure.

As shown in FIG. 1 and FIG. 2, the cosmetic applicator 1 comprises an application member assembly 10 retained at a distal end of a rod 40 for applying a cosmetic, makeup, or a care product on skin or on keratinous fibers in the area of mascara application, lash care, mascara removal, lip application, hair coloring and hair repair. The application member assembly 10 comprises an elongated hollow casing 12, a multiplicity of application elements 14 projecting from an outer surface 16 of the casing 12, a non-resilient member 18 disposed within the hollow casing 12 and a locking member 20 retaining the casing 12 with respect to the non-resilient member 18. An elongated cup member 42 is fixed to a proximal end of the rod 40 such as being integrally formed therewith.

Figure 3:
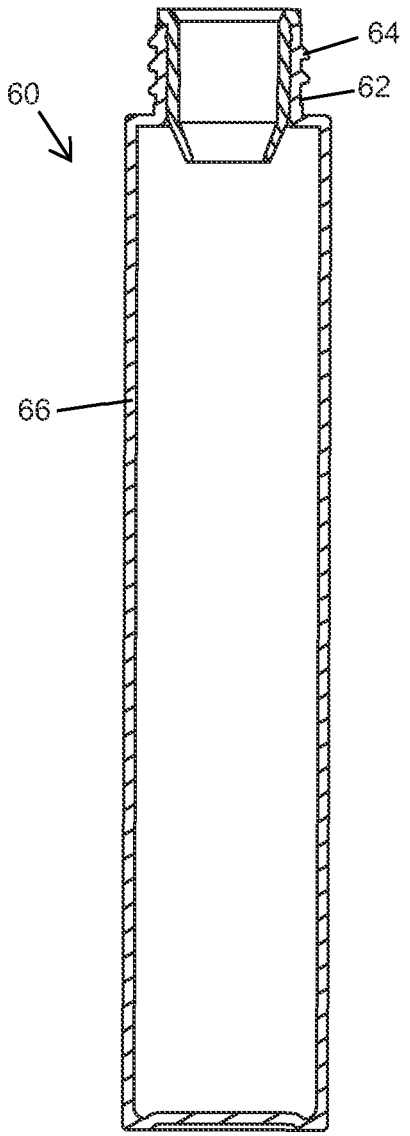
FIG. 3 illustrates a cross-sectional view of a container for use in relation to the cosmetic applicator of FIG. 1.
Figure 4:
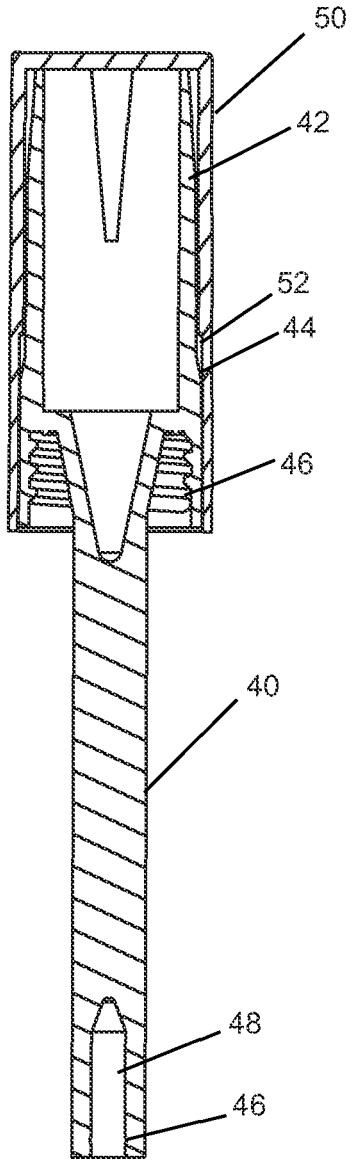
FIG. 4 illustrates a cross-sectional view of the cosmetic applicator of FIG. 1 without the application member assembly.

As shown in FIG. 3 and FIG. 4; a handle 50 is retained at the proximal end of the rod 40 by having the cup member 42 received within the handle 50. An annular ridge 44 of the cup member 42 contacts an annular shoulder 52 formed in an inner wall surface of the handle 50. The handle 50 and the cup member 42 can be engaged together by any attachment means, including friction, mechanical engagement, adhesive, heat or sonic welding, or any other suitable method or methods.

Threads 46 are disposed on the inner wall surface of the cup member 42. In use, the threads 46 engage corresponding threads 64 on a neck 62 of a container 60 having a body 66 which acts as a reservoir for cosmetic, makeup, or a care product (not shown). The cosmetic, makeup, or a care product is in form of liquid or pasty material, including mascara. The body 66 of the container 60 can be formed from a plastic, glass, metal or any other material.

Figure 5:
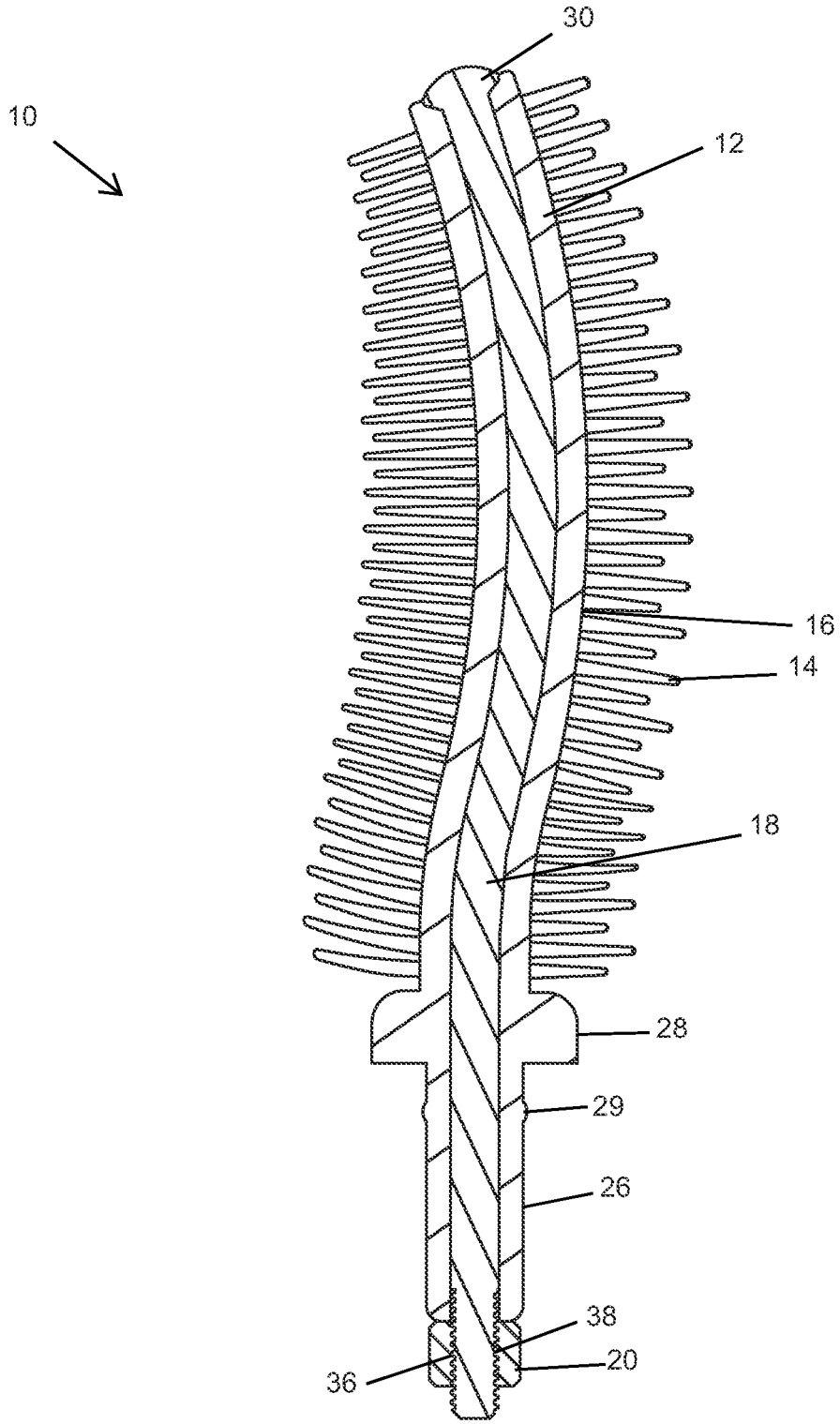
FIG. 5 illustrates an enlarged cross-sectional view of the application member assembly of FIG. 1.
Figure 6A:
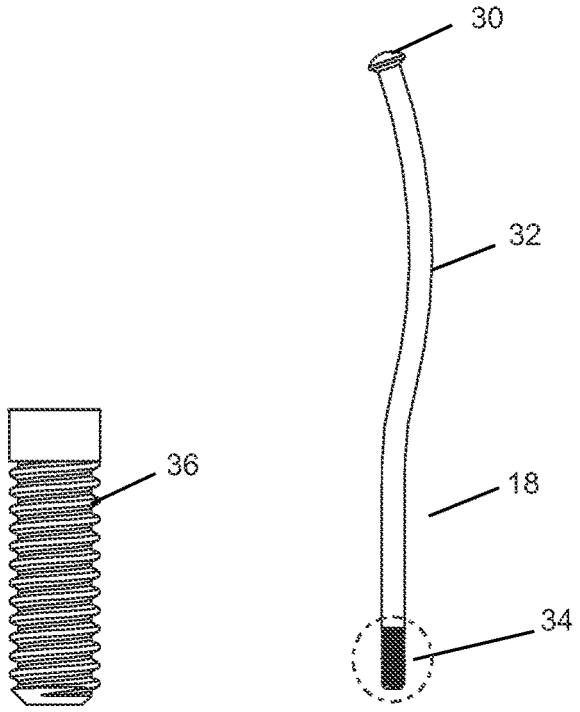
FIG. 6*a* illustrates an enlarged view of a proximal end portion of a non-resilient member shown in FIG. 6.
Figure 6:
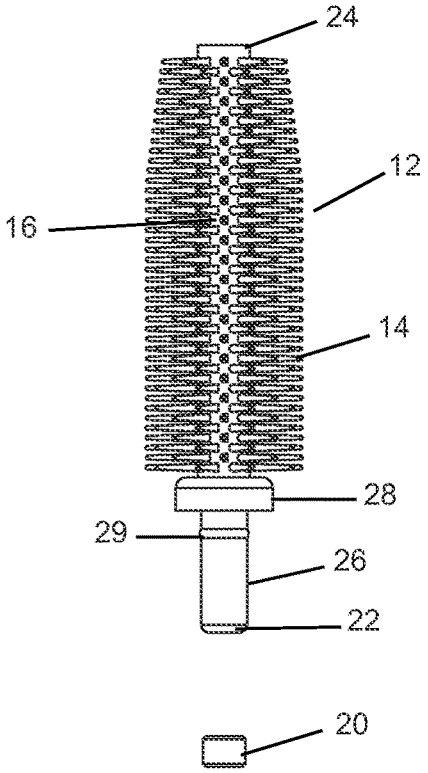
FIG. 6 illustrates an exploded view of the application member assembly of FIG. 5.

The application member assembly 10 and the method of making it can be better understood from FIG. 5 and FIG. 6. As shown in FIG. 5 and FIG. 6, the application member assembly 10 comprises a resilient elongated casing 12 with a hollow cavity and having an open proximal end 22 and an open distal end 24. A multiplicity of application elements 14 project laterally outwardly from the outer surface 16 over a major portion of a length of the casing 12. The proximal end portion of the casing 12 is formed as a shank 26 and is free from the application elements 14. A radially extending flange 28 is provided between the shank 26 and the application elements-bearing portion of the casing 12.

According to another embodiment of the disclosure, the application member assembly 10 further comprises a non-resilient member 18 including a head 30 at its distal end, a main body portion 32 and a proximal end portion including a locking region 34 having at least two progressively tightening and locking features 36. According to yet another embodiment of the disclosure, the at least two progressively tightening and locking features 36 may include ribs, ratchets and the like. The locking region 34 is defined over a sufficient length of the non-resilient member 18 which permits to attain different locking positions for the casing 12 at the proximal end portion and thus varied lengths of the elongated casings 12 can be used along with the same non-resilient member 18.

The main body portion 32 of the non-resilient member 18 comprises a curved upper part and a straight lower part. However, it is within the scope of the present disclosure that the main body portion 32 may be straight or substantially straight over its entire length or it may have any curved profile. The non-resilient member 18 is inserted into the hollow cavity of the casing 12 such that the head 30 at the distal end of the non-resilient member 18 is retained at the distal end 24 of the casing 12, the main body portion 32 lies inside the hollow cavity of the casing 12 and a major portion of the locking region 34 having at least two progressively tightening and locking features 36 extends out from the proximal end 22 of the casing 12. When the non-resilient member 18 is inserted into the casing 12, the curved upper part of the main body portion 32 causes the hollow casing 12 to pursue the same curved profile.

Further, the diameter of the head 30 at the distal end of the non-resilient member 18 is greater than the diameter of the hollow cavity of the casing 12, therefore when the non-resilient member 18 is inserted into the hollow cavity of the casing 12, the head 30 at the distal end of the non-resilient member 18 is retained outside the casing 12 at the distal end 24 of the casing 12.

According to an alternate embodiment of the disclosure, the non-resilient member 18 is of a length longer than the length of the casing 12.

According to yet another embodiment of the disclosure, a portion of the locking region 34 of the non-resilient member 18 lies inside the casing 12.

According to yet another embodiment of the disclosure, the portion of the locking region 34 of the non-resilient member 18 which lies inside the casing 12 is smaller in length than the portion of the locking region 34 of the non-resilient member 18 which extends out from the proximal end 22 of the casing 12.

According to another embodiment of the disclosure, the application member assembly 10 comprises a locking member 20 engaged to the locking region 34 at the proximal end portion of the non-resilient member 18 for further retaining and optimally locking the casing 12 at its proximal end 22 with respect to the non-resilient member 18 such that the casing 12 is axially immovable with respect to the non-resilient elongated member 18 and thus prevents the non-resilient member 18 to slip out of the casing 12.

The locking member 20 includes a tubular member including locking features in form of spiral threads 38 on its inner surface wherein the spiral threads 38 are complementary to the at least two progressively tightening and locking features in form of spiral threads 36 in the locking region 34 at the proximal end portion of the non-resilient member 18. The locking member 20 is retained on to locking region 34 at the proximal end portion of the non-resilient member 18 by mating of the spiral threads 38 on its inner surface with the corresponding spiral threads 36 of the locking region 34 at the proximal end portion of the non-resilient member 18, for locking the non-resilient member 18 with respect to the proximal end 22 of the casing 12.

According to another embodiment of the disclosure, the locking member 20 includes locking features including pawls, hooks and the like.

The method of assembling the application member assembly 10 comprises inserting the non-resilient elongated member 18 into the casing 12 such that the head 30 at the distal end of the non-resilient elongated member 18 is retained outside the casing 12 at the distal end 24 of the casing 12 and the proximal end portion of the non-resilient elongated member 18 extends out from the proximal end 22 of the resilient casing 12; and thereafter, locking the proximal end 22 of the casing 12 with respect to the proximal end portion of the non-resilient elongated member 18 using the locking member 20 having a locking feature that engages with a corresponding locking feature present at the proximal end portion of the non-resilient elongated member 18 such that the resilient casing 12 is axially immovable relative to the non-resilient elongated member 18.

A method of fixing the application member assembly 10 to the rod 40 can be better understood from FIG. 2 to FIG. 6.

The proximal end portion/shank 26 of the casing 12 and the locking region 34 at the proximal end portion of the non-resilient member 18 engaged with locking member 20 are received into an elongated hole 48 of the rod 40. The proximal end portion/shank 26 of the casing 12 is fixed to the rod 40 and to the non-resilient member 18. In other words, the proximal end portion/shank 26 of the casing 12 is fixed to the rod 40 and to the non-resilient member 18 so as to be sandwiched between the rod 40 and the non-resilient member 18. The flange 28 is of similar cross-section as that of the rod 40 and rests at the distal end of the rod 40.

The proximal end portion/shank 26 of the casing 12 includes an annular bead 29 which is engaged with a corresponding recess 46 inside the hole 48 of the rod 40.

The proximal end portion/shank 26 of the casing 12 may be engaged inside the hole 48 of the rod 40 by other suitable attachment means. The suitable attachment means includes a pin, a snap, a j-lock, a progressively tightening and locking feature engagement, an interference engagement or the like.

Figure 7:
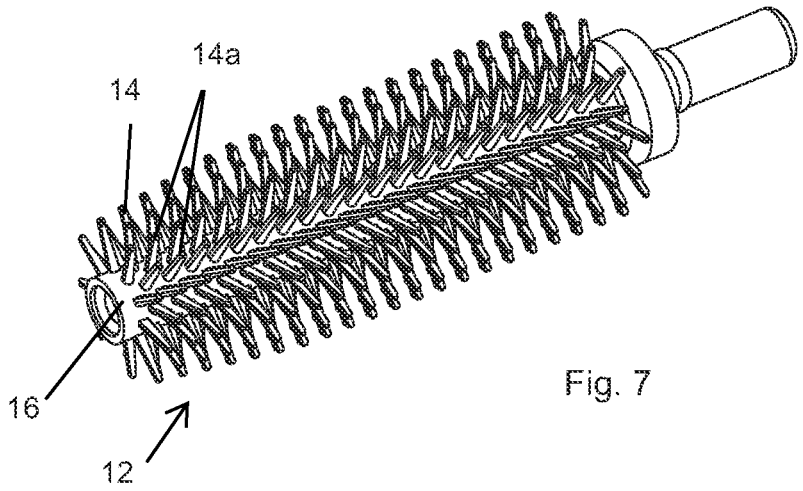
FIG. 7 illustrates a perspective view of the casing of the application member assembly of FIG. 5.
Figure 8:
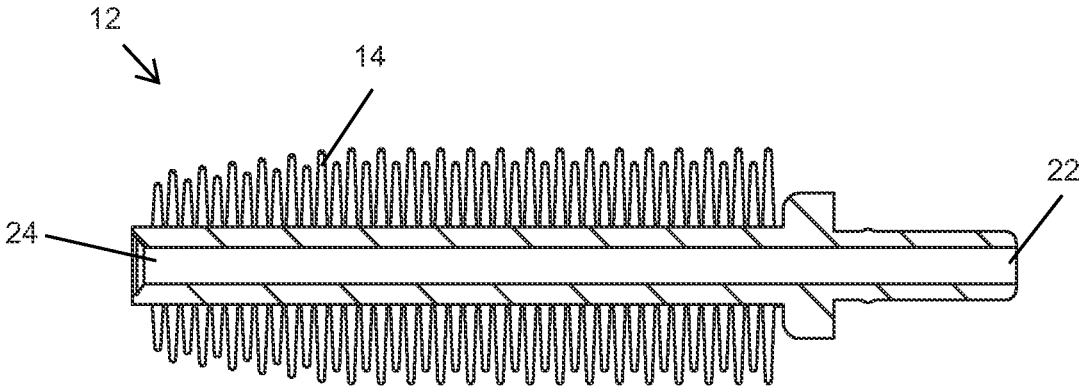
FIG. 8 illustrates a cross-sectional view of the casing of FIG. 7.

As shown in FIG. 7 and FIG. 8, the cylindrical casing 12 has an open proximal end 22 and an open distal end 24. The casing 12 comprises the application elements 14 in form of teeth. Alternately, the application elements 14 may be in the form of bristles. The application elements 14 are arranged in a plurality of rows 14*a* extending lengthwise from outer surface 16 of the casing 12. The application elements 14 in the plurality of rows 14*a* may be arranged alternately to achieve a variety of configurations for such purposes as enhancing lash-thickening, lash-lengthening and/or lash-separation effects incident to mascara application. According to an alternate embodiment, the application elements 14 may be covered by a flock coating or may be a flock themselves or a sponge.

Figure 9:
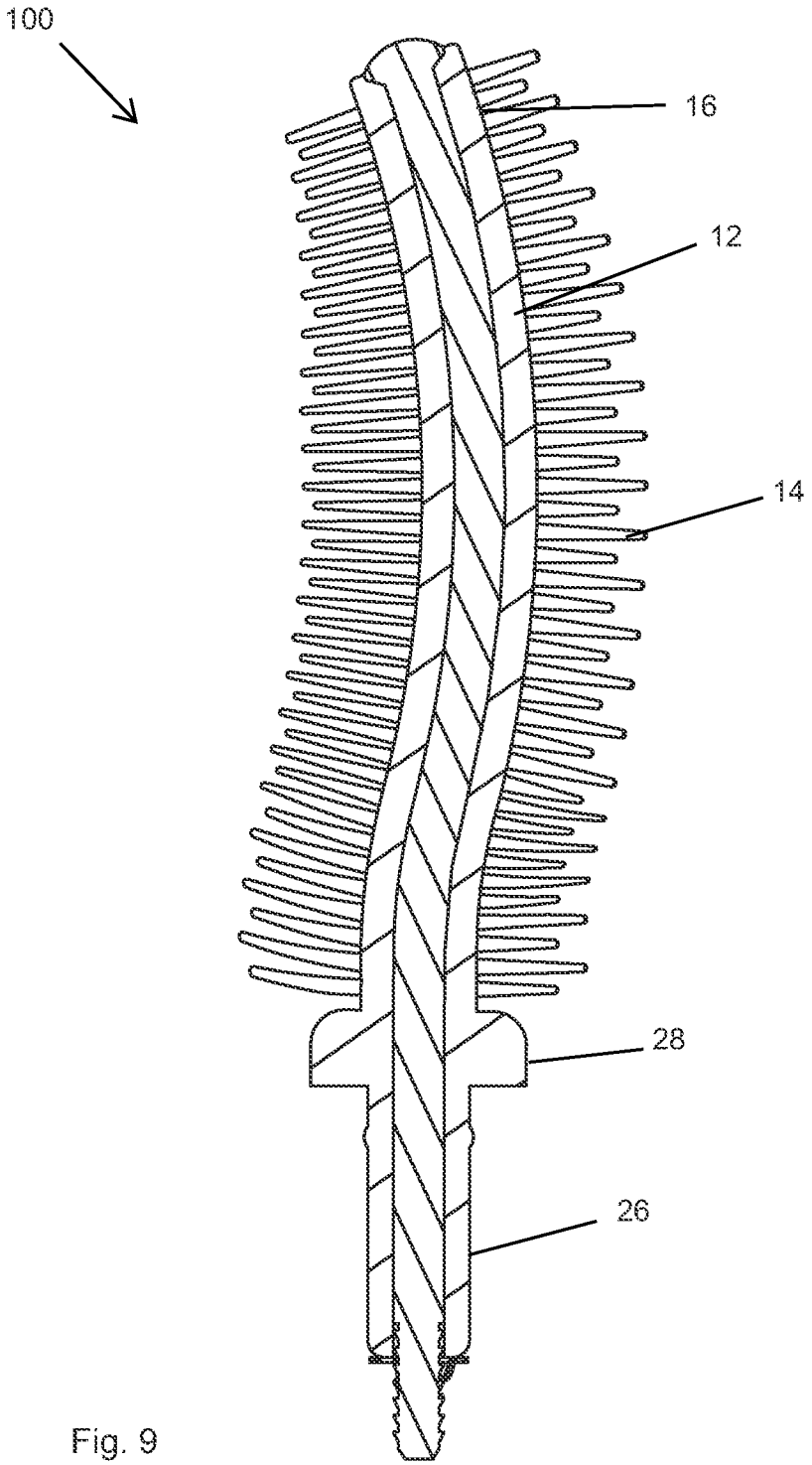
FIG. 9 illustrates a cross-sectional view of an application member assembly according to another embodiment of the disclosure.
Figure 10A:
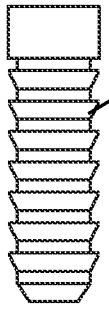
FIG. 10*a* illustrates an enlarged view of a proximal end portion of a non-resilient member shown in FIG. 10.
Figure 10B:
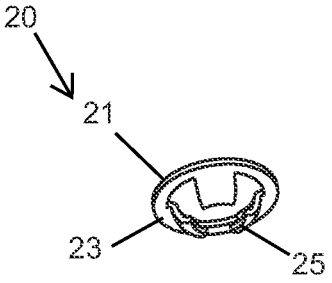
FIG. 10*b* illustrates an enlarged view of a locking member shown in FIG. 10.
Figure 10:
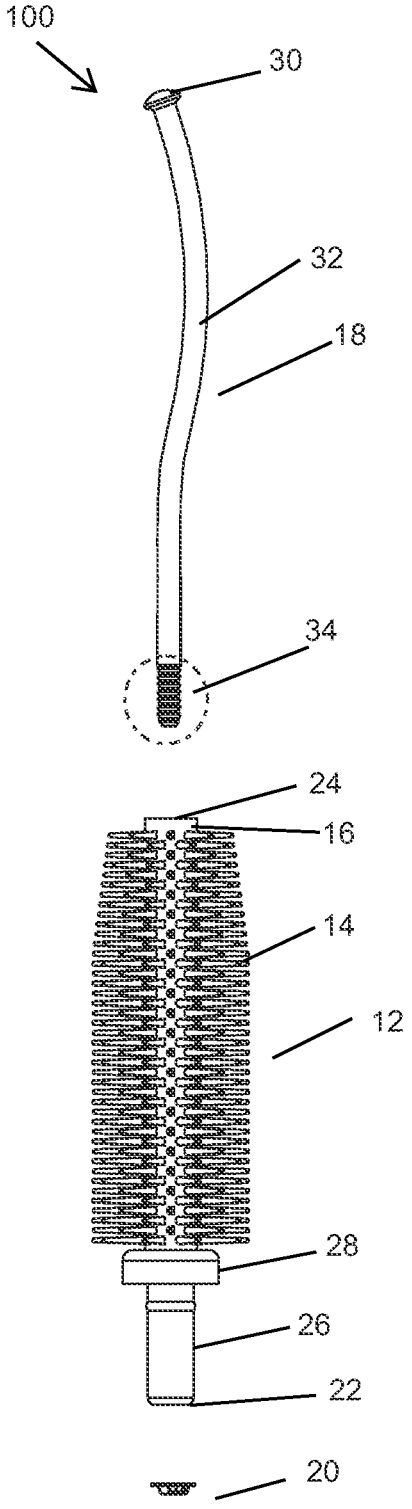
FIG. 10 illustrates an exploded view of the application member assembly of FIG. 9.

FIG. 9 and FIG. 10 illustrate a cross-sectional view and an exploded view of an application member assembly 100 according to variant embodiment of the disclosure. The application member assembly 100 also comprises a resilient elongated casing 12 with a hollow cavity and having an open proximal end 22 and an open distal end 24. A multiplicity of application elements 14 project laterally outwardly from the outer surface 16 of the casing 12. The proximal end portion of the casing 12 is formed as a shank 26 and is free from the application elements 14. A radially extending flange 28 is provided between the shank 26 and the application elements-bearing portion of the casing 12.

The application member assembly 100 also comprises a non-resilient member 18 including a head 30 at its distal end, a main body portion 32 and a proximal end portion including a locking region 34 having at least two progressively tightening and locking features 36.

The non-resilient member 18 is inserted into the hollow cavity of the casing 12 such that the head 30 at the distal end of the non-resilient member 18 is retained outside the hollow cavity of the casing 12 at the distal end 24 of the casing 12, locking the casing 12 at the distal end 24 with respect to the non-resilient member 18.

The locking region 34 at the proximal end portion of the non-resilient member 18 includes at least two progressively tightening and locking features such as unidirectional ratchets 36.

The application member assembly 100 comprises a locking member 20 engaged to the locking region 34 at the proximal end portion of the non-resilient member 18 for further retaining and optimally locking the casing 12 at its proximal end 22 with respect to the non-resilient member 18 and thus prevents the non-resilient member 18 to slip out of the casing 12.

The locking member 20 includes a ring member 21 having a flat surface 23 and at least one locking feature herein shown as a pawl 25 extending from the flat surface 23 and wherein the pawl 25 is complementary to the at least two progressively tightening and locking features including unidirectional ratchets 36 at the proximal end portion of the non-resilient member 18. The ring member 21 is retained on to the locking region 34 at the proximal end portion of the non-resilient member 18 by engagement of the at least one pawl 25 with the unidirectional ratchet 36, for locking the non-resilient member 18 with respect to the proximal end of the casing 12.

According to yet another embodiment of the disclosure, the casing 12 and the application elements 14 may be molded integrally from a material so that the application elements 14 and the casing 12 are soft and resilient in nature. The soft and resilient casing 12 and the application elements 14 provide a very gentle application and avoid the risk of being impaired when they are stressed mechanically. They may be made, for example, of a material from the following list: elastomer, for example thermoplastic elastomer, LDPE, PVC, PU, thermoplastic polyester elastomer, EPDM, PDM, EVA, SIS, SEBS, SBS, latex, silicone, nitrile, butyl, polyurethane, polyether-block-amide, and polyester. They may be made of a single material or, by bi-injection-molding of two different materials, for example of two different colors.

According to another embodiment of the disclosure, the non-resilient member 18 is made up of a metal or a hard material which is capable of providing non-resilient properties. Apart from metal, the non-resilient member 18 may be made from thermoplastic material selected from the following list: HDPE, LDPE, linear PE, PP, PT, POM, PA, PET and PBT.

According to another embodiment of the disclosure, the non-resilient member 18 is made up of a material harder than the material of the casing 12. This results in an application member assembly 10 or 100 which is sufficiently stiff to allow effective application on the area to be treated, due to the presence of the non-resilient member 18, while ensuring gentle application, due to the casing 12 of more resilient material which comes into contact with the area to be treated.

According to another embodiment of the disclosure, the non-resilient member 18 having a main body portion 32 for being received through the elongated hollow casing 12 can be used to achieve varied cross-sectional and longitudinal profiles of the hollow casing 12. By way of example, the main body portion 32 can in certain cases have a non-circular cross section, such as a rounded triangular cross section, a rounded rectangle cross section, or a rounded square cross section, to cause the hollow casing 12 to tend to pursue that same non-circular cross section (not shown in drawings).

Although the foregoing is directed to embodiments of the present disclosure, other and further embodiments of the disclosure may be devised without departing from the basic scope thereof, and the scope thereof is determined by the claims that follow. Accordingly, the appended claims should be construed to encompass not only those forms and embodiments of the disclosure specifically described above, but to such other forms and embodiments as may be devised by those skilled in the art without departing from its true spirit and scope.

What is claimed is:

1. A cosmetic applicator for applying a product, the cosmetic applicator comprising:

a rod; and an application member assembly configured to be received into an elongated hole present at a distal end of the rod;

wherein the application member assembly includes an elongated casing, a non-resilient elongated member, and a locking member;

wherein the elongated casing has a hollow cavity, an open proximal end and an open distal end, wherein the locking member is ring shaped and present outside the hollow cavity of the casing and below the open proximal end of the casing;

wherein the non-resilient elongated member is disposed within the hollow cavity of the casing and extends along a length of the casing;

wherein the non-resilient elongated member has a proximal end portion, a main body portion and a distal end;

wherein the non-resilient elongated member comprises a locking region at its proximal end portion and a head at its distal end;

wherein the locking region includes locking features;

wherein the head at the distal end of the non-resilient elongated member is retained outside the hollow cavity of the casing at the distal end of the casing;

wherein the main body portion of the non-resilient elongated member lies inside the hollow cavity of the casing;

wherein at least a portion of the locking region of the non-resilient elongated member extends out from the proximal end of the casing;

wherein the locking member is provided as a separate and independent part from the casing and the non-resilient elongated member;

wherein the locking member comprises locking features that are complementary to the locking features of the locking region of the non-resilient elongated member;

wherein the locking member engages with said at least portion of the locking region of the non-resilient elongated member below the proximal end of the casing;

wherein the head at the distal end of the non-resilient elongated member and the locking member below the open proximal end of the casing cause the casing to be axially immovable with respect to the non-resilient elongated member; and wherein the non-resilient elongated member and the casing do not have any locking features on their outer and inner surfaces respectively to lock each other.

2. The cosmetic applicator of claim 1, wherein the locking region is defined over a portion of a length of the non-resilient elongated member which permits to attain different locking positions for the casing at the proximal end portion of the non-resilient elongated member.

3. The cosmetic applicator of claim 2, wherein the locking features of the locking region includes unidirectional ratchets.

4. The cosmetic applicator of claim 2, wherein the locking features of the locking region includes spiral threads or grooves.

5. The cosmetic applicator of claim 4, wherein the locking member comprises locking features in form of spiral threads or ribs that are complementary to the spiral threads or grooves formed at the locking region of the non-resilient elongated member.

6. The cosmetic applicator of claim 3, wherein the locking member includes a ring member having a flat surface and at least one locking feature in form of a pawl and wherein the ring member is retained on to the proximal end portion of the non-resilient elongated member by mating of the pawl with one of the unidirectional ratchets present on the proximal end portion of the non-resilient elongated member.

7. The cosmetic applicator of claim 1, wherein the casing is made from a resilient material.

8. The cosmetic applicator of claim 1, wherein the non-resilient elongated member is made up of a material harder than a material of the casing.

9. The cosmetic applicator of claim 8, wherein the material of the non-resilient elongated member is selected from a thermoplastic material or a metal.

10. The cosmetic applicator of claim 1, wherein the application member assembly comprises at least one application element on an outer surface of the casing.

11. The cosmetic applicator of claim 10, wherein the at least one application element is selected from teeth, bristles, sponge and flocking.

12. The cosmetic applicator of claim 10, wherein the proximal end portion of the casing is formed as a shank and is free from the at least one application element and wherein a radially extending flange is provided between the shank and an application elements-bearing portion of the hollow cavity of the casing.

13. The cosmetic applicator of claim 1, wherein a portion of the main body portion of the non-resilient elongated member has a curved profile.

14. The cosmetic applicator of claim 1, wherein a diameter of the head at the distal end of the non-resilient elongated member is greater than a diameter of the casing.

15. The cosmetic applicator of claim 1, wherein at least one another portion of the locking region of the non-resilient elongated member lies inside the hollow cavity of the casing.

16. The cosmetic applicator of claim 1, wherein the rod includes an elongated cup member at a proximal end of the rod and wherein a handle is retained at the proximal end of the rod by having the cup member received within the handle.

17. The cosmetic applicator of claim 1, wherein a proximal end portion of the application member assembly is engaged inside the elongated hole of the rod by a suitable attachment means selected from a pin, a snap, a j-lock and an interference engagement.

18. A method of assembling the application member assembly of claim 1, the method comprising:

inserting the non-resilient elongated member into the casing such that the head at the distal end of the non-resilient elongated member is retained outside the casing at the distal end of the casing and the proximal end portion of the non-resilient elongated member extends out from the proximal end of the resilient casing; and thereafter, locking the proximal end of the casing with respect to the proximal end portion of the non-resilient elongated member using the locking member having a locking feature that engages with a corresponding locking feature present at the proximal end portion of the non-resilient elongated member such that the resilient casing is axially immovable relative to the non-resilient elongated member.

19. An application member assembly connected at a distal end of a rod, the application member assembly comprising:

an elongated casing having a hollow cavity, the casing having an open proximal end and an open distal end, a non-resilient elongated member disposed within the casing and extending along a length of the casing;

wherein the non-resilient elongated member has a proximal end portion, a main body portion and a distal end;

wherein the non-resilient elongated member comprises a locking region at its proximal end portion and a head at its distal end;

wherein the locking region includes locking features;

wherein the head at the distal end of the non-resilient elongated member is retained outside the casing at the distal end of the casing;

wherein the main body portion of the non-resilient elongated member lies inside the casing;

wherein at least a portion of the locking region of the non-resilient elongated member extends out from the proximal end of the casing;

wherein a locking member is present outside the hollow cavity of the casing and below the open proximal end of the casing;

wherein the locking member is ring shaped and provided as a separate and independent part from the casing and the non-resilient elongated member;

wherein the locking member comprises locking features that are complementary to the locking features of the locking region of the non-resilient elongated member;

wherein the locking member engages with said at least portion of the locking region of the non-resilient elongated member below the proximal end of the casing;

wherein the head at the distal end of the non-resilient elongated member and the locking member below the open proximal end of the casing cause the casing to be axially immovable with respect to the non-resilient elongated member;

wherein the non-resilient elongated member and the casing do not have any locking features on their outer and inner surfaces respectively to lock each other;

wherein at least a portion of the main body portion has a curved profile; and wherein the casing adapts to the profile of the non-resilient elongated member.

20. An application member assembly at a distal end of a rod, the application member assembly comprising:

a resilient elongated tubular casing having an open proximal end and a distal end, a multiplicity of application elements projecting from an outer surface of the tubular casing, a non-resilient elongated member disposed within the tubular casing and extending along a length of the tubular casing;

wherein the non-resilient elongated member has a proximal end portion, a main body portion and a distal end;

wherein the non-resilient elongated member comprises a locking region at its proximal end portion and a head at its distal end;

wherein the locking region includes locking features;

wherein the head at the distal end of the non-resilient elongated member is retained outside the tubular casing at the distal end of the tubular casing;

wherein the main body portion of the non-resilient elongated member lies inside the tubular casing;

wherein at least a portion of the locking region of the non-resilient elongated member extends out from the proximal end of the tubular casing;

wherein a locking member is ring shaped and present outside a hollow cavity of the tubular casing and below the open proximal end of the tubular casing;

wherein the locking member is provided as a separate and independent part from the tubular casing and the non-resilient elongated member;

wherein the locking member comprises locking features that are complementary to the locking features of the locking region of the non-resilient elongated member;

wherein the locking member engages with said at least portion of the locking region of the non-resilient elongated member below the proximal end of the tubular casing;

wherein the head at the distal end of the non-resilient elongated member and the locking member below the open proximal end of the tubular casing cause the tubular casing to be axially immovable with respect to the non-resilient elongated member;

wherein the non-resilient elongated member and the tubular casing do not have any locking features on their outer and inner surfaces respectively to lock each other;

wherein at least a portion of the main body portion has a curved profile; and wherein the tubular casing adapts to the profile of the non-resilient elongated member such that at least some of the application elements on a portion of the tubular casing converge towards each other and some of the application elements on another portion of the tubular casing diverge away from each other.

* * * * *